US009915470B2

(12) United States Patent
Kim et al.

(10) Patent No.: US 9,915,470 B2
(45) Date of Patent: Mar. 13, 2018

(54) REFRIGERATOR

(71) Applicant: LG ELECTRONICS INC., Seoul (KR)

(72) Inventors: Hyungki Kim, Seoul (KR); Junyi Heo, Seoul (KR); Jihyun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/516,929

(22) PCT Filed: Oct. 21, 2015

(86) PCT No.: PCT/KR2015/011126
§ 371 (c)(1),
(2) Date: Apr. 5, 2017

(87) PCT Pub. No.: WO2016/064182
PCT Pub. Date: Apr. 28, 2016

(65) Prior Publication Data

US 2017/0299255 A1 Oct. 19, 2017

(30) Foreign Application Priority Data

Oct. 22, 2014 (KR) ..... 10-2014-0143159

(51) Int. Cl.
*F25D 23/00* (2006.01)
*F25D 25/02* (2006.01)
(Continued)

(52) U.S. Cl.
CPC ..... *F25D 25/025* (2013.01); *A47B 88/477* (2017.01); *F25D 23/04* (2013.01); *F25D 2323/023* (2013.01); *F25D 2323/024* (2013.01)

(58) Field of Classification Search
CPC ..... F25D 23/025; F25D 23/02; F25D 23/028; F25D 23/04; F25D 25/025; F25D 2323/023
See application file for complete search history.

(56) References Cited

U.S. PATENT DOCUMENTS

2011/0016908 A1 1/2011 Kim
2011/0023528 A1 2/2011 Kwon et al.
(Continued)

FOREIGN PATENT DOCUMENTS

KR 10-2009-0132398 12/2009
KR 10-2011-0080021 7/2011
KR 10-2014-0105687 9/2014

OTHER PUBLICATIONS

International Search Report in International Application No. PCT/KR2015/011126, dated Jan. 18, 2016, 2 pages.

*Primary Examiner* — Daniel J Rohrhoff
(74) *Attorney, Agent, or Firm* — Fish & Richardson P.C.

(57) ABSTRACT

A refrigerator according to an embodiment of the present invention may include: a basket assembly slidably coupled to a first door in a front-to-rear direction of the first door, wherein the basket assembly comprises: a basket configured to accommodate food; a first base provided to be slidable in the front direction of the first door by passing through the opening of the first door, the basket being placed on an upper surface of the first base; a second base provided to be slidable in the rear direction of the first door, the first base being slidably coupled to an upper surface of the second base; and a third base of which a front end is fixed to a rear surface of the first door, wherein the second base is slidably coupled to an upper surface of the third base.

16 Claims, 9 Drawing Sheets

(51) Int. Cl.
*F25D 23/04* (2006.01)
*A47B 88/477* (2017.01)

(56) References Cited

U.S. PATENT DOCUMENTS

| | | | | |
|---|---|---|---|---|
| 2013/0104590 | A1* | 5/2013 | Seo | F25D 23/04 62/340 |
| 2014/0239790 | A1* | 8/2014 | Yoo | F25D 25/025 312/404 |
| 2017/0082351 | A1* | 3/2017 | Jung | F25D 11/02 |
| 2017/0184335 | A1* | 6/2017 | Jeon | F25D 23/02 |
| 2017/0191740 | A1* | 7/2017 | Jung | F25D 23/04 |
| 2017/0191741 | A1* | 7/2017 | Jung | F25D 23/04 |
| 2017/0191745 | A1* | 7/2017 | Choi | H05B 37/0281 |
| 2017/0219275 | A1* | 8/2017 | Suh | F25D 25/025 |
| 2017/0276423 | A1* | 9/2017 | Jung | F25D 23/028 |
| 2017/0299256 | A1* | 10/2017 | Yu | F25D 25/027 |

* cited by examiner

【Figure 1】
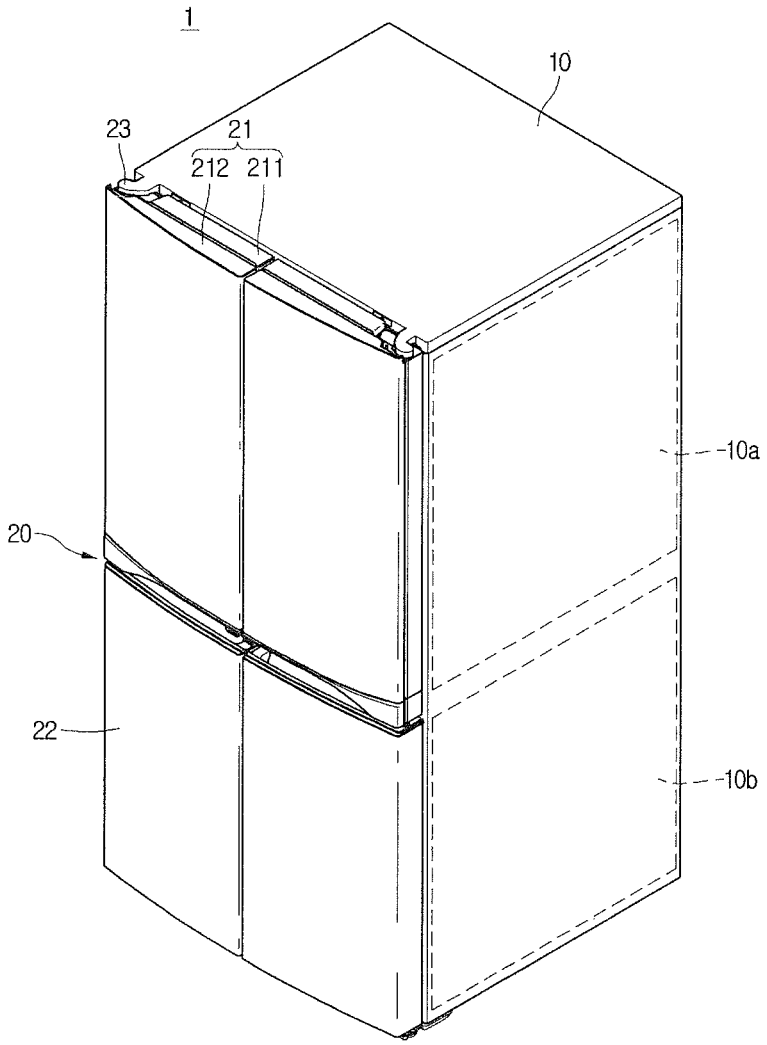

【Figure 2】
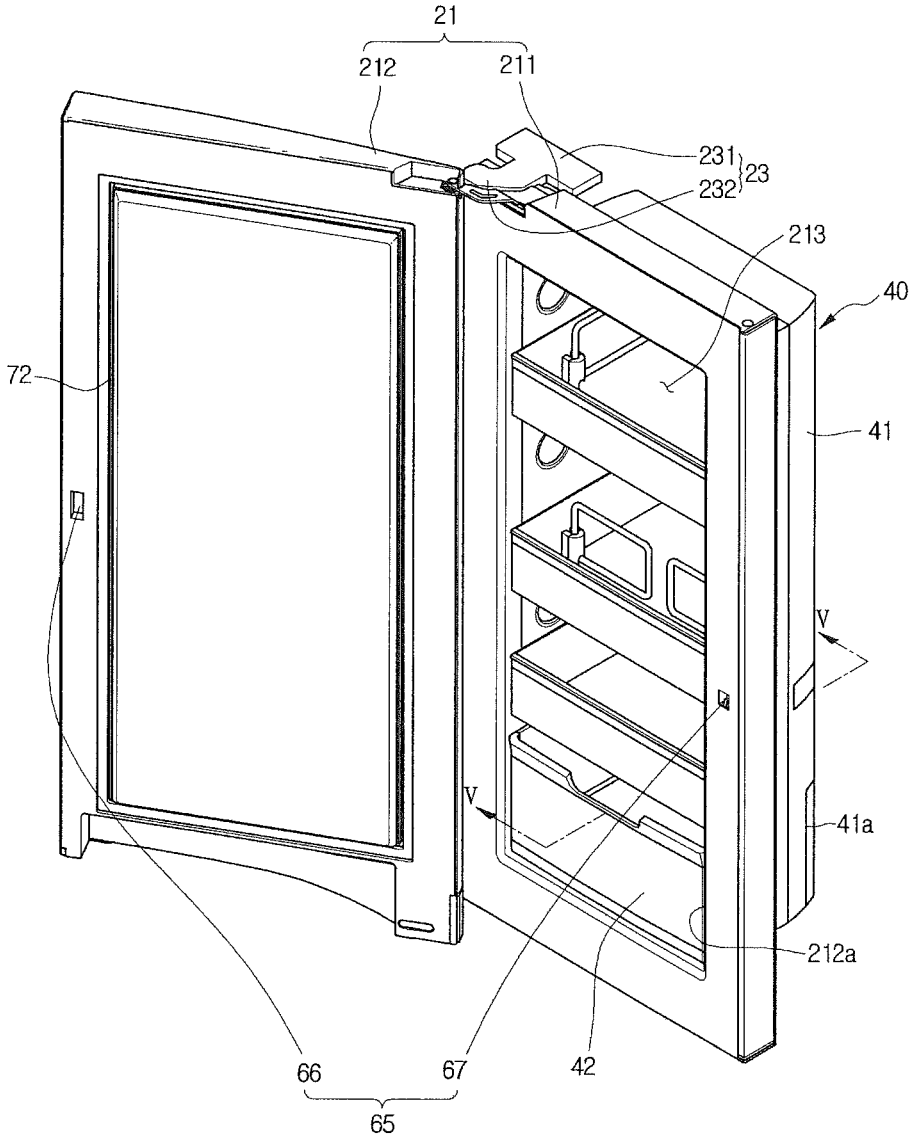

【Figure 3】
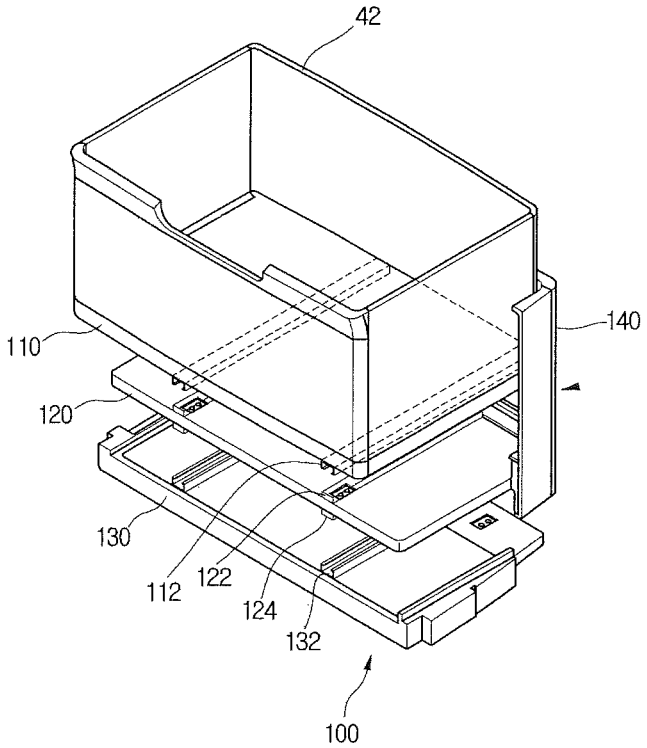
【Figure 4】
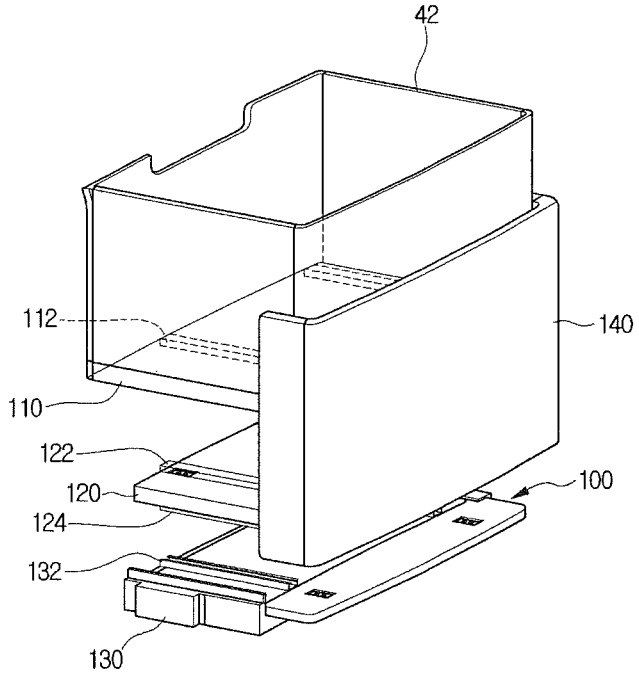

【Figure 5】
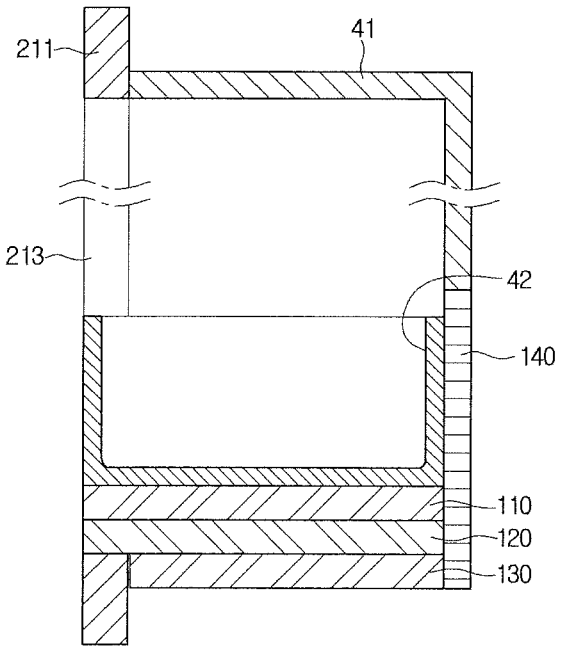

【Figure 6】
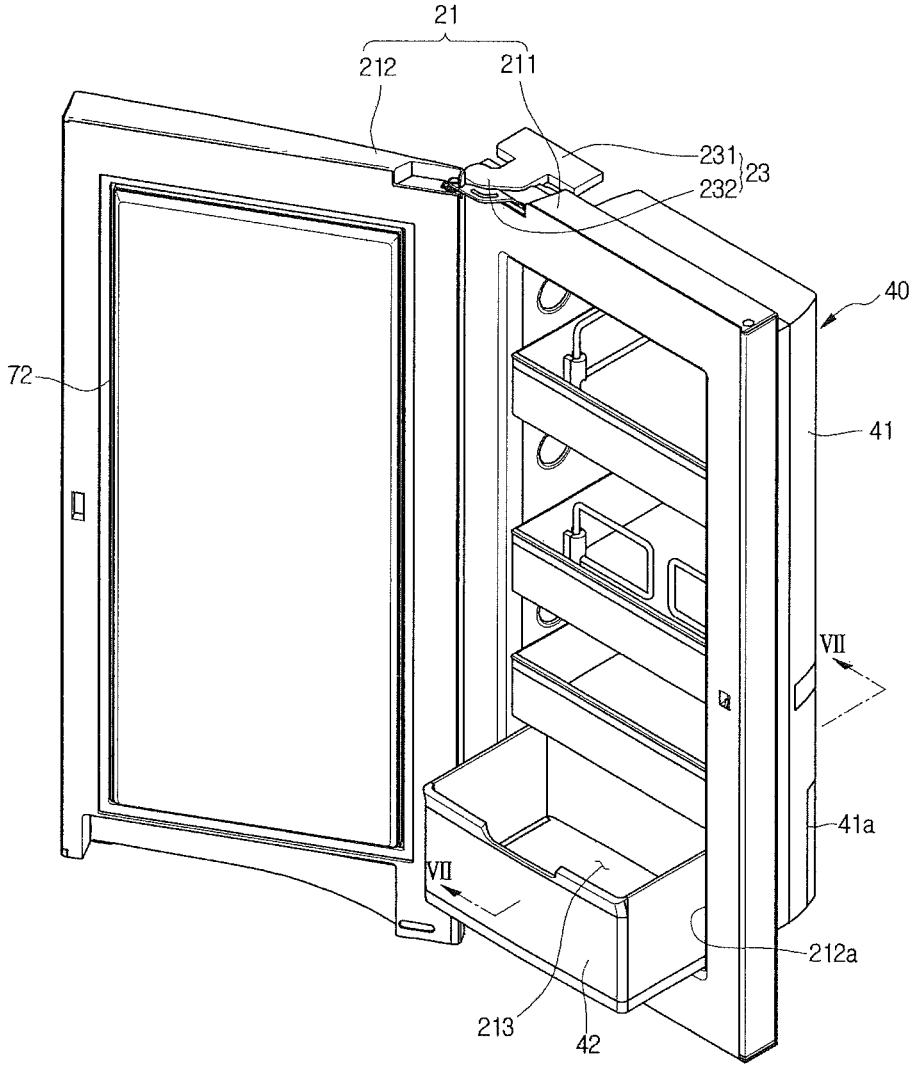

【Figure 7】
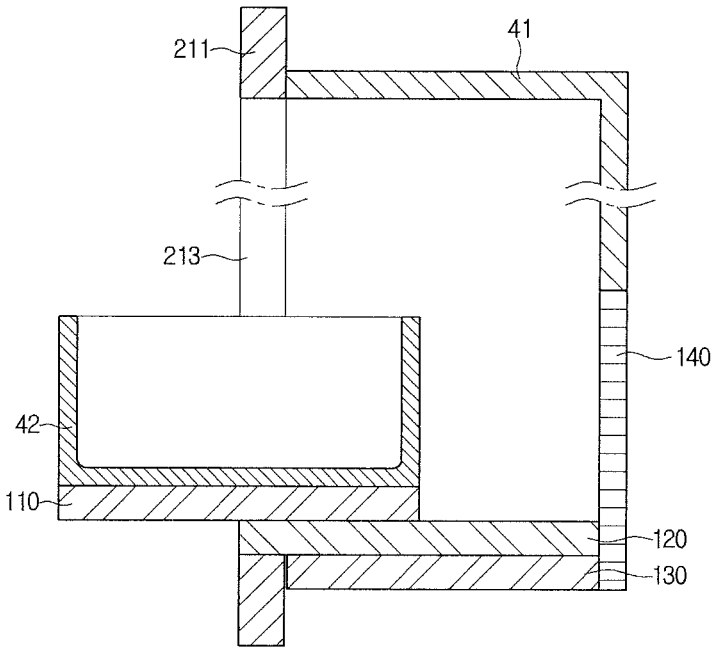

【Figure 8】
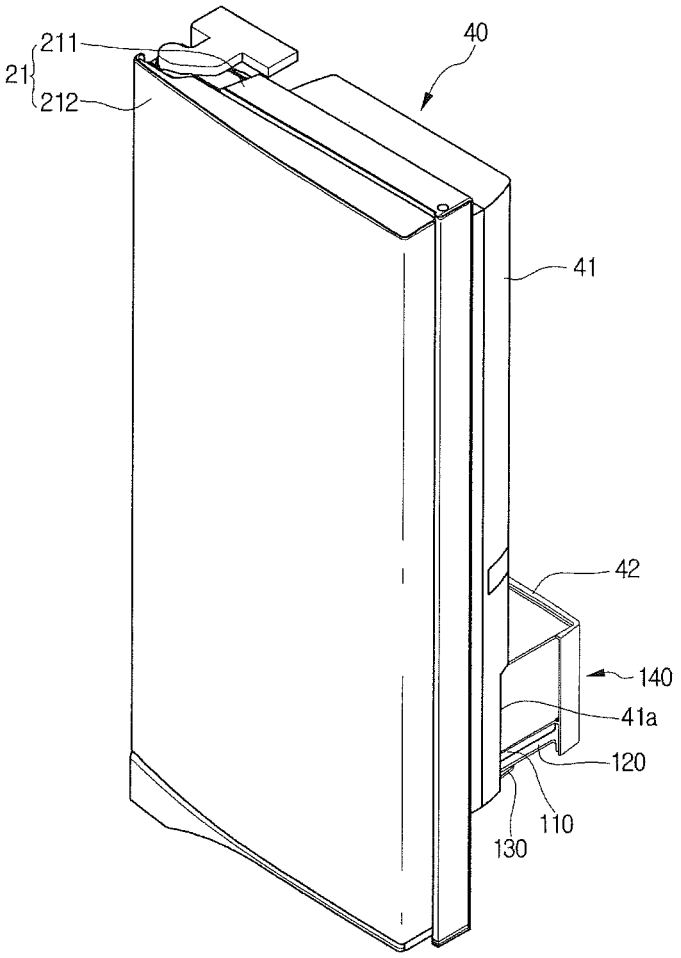

【Figure 9】
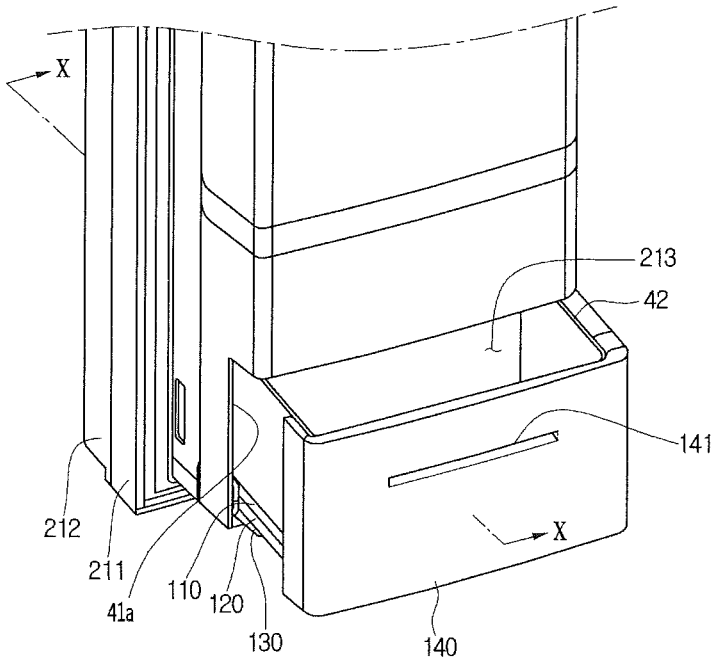

【Figure 10】
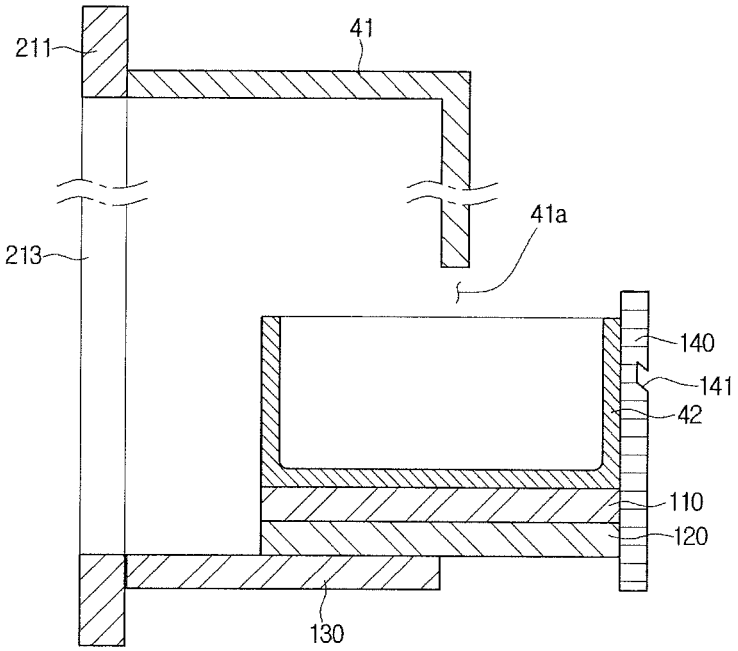

REFRIGERATOR

CROSS REFERENCE TO RELATED APPLICATIONS

This application is a U.S. National Phase Application under 35 U.S.C. § 371 of International Application PCT/KR2015/011126, filed on Oct. 21, 2015, which claims the benefit of Korean Application No. 10-2014-0143159, filed on Oct. 22, 2014, the entire contents of which are hereby incorporated by reference in their entireties.

TECHNICAL FIELD

The present invention relates to a refrigerator.

BACKGROUND ART

Generally, one or a plurality of baskets for accommodating food or a container which should be kept refrigerated or frozen may be installed at a rear surface of a refrigerator door. The plurality of baskets may be vertically disposed at the rear surface of the refrigerator door.

In the case of a conventional refrigerator, a door basket provided at a rear door is formed to be movable only forward. Also, the door basket may be moved forward only when a front door is opened.

In such a structure of the door basket, there is a disadvantage in that the door basket is opened in only one direction. Therefore, it has an inconvenient disadvantage in that food accommodated in the door basket can be taken out, or the food can be accommodated in the door basket at a rear of the rear door, only after the rear door is opened.

DISCLOSURE

Technical Problem

The present invention is directed to providing a refrigerator which improves the above-mentioned problems.

Technical Solution

One aspect of the present invention provides a refrigerator. The refrigerator may include: a cabinet configured to form a storage space; a first door coupled to a front surface of the cabinet to selectively open and close the storage space, and having an opening formed therein; a second door coupled to a front surface of the first door and configured to selectively open and close the opening of the first door; a first hinge configured to rotatably couple the first door to the cabinet; a second hinge configured to rotatably couple the second door to the first door; and a basket assembly slidably coupled to the first door in a front-to-rear direction of the first door.

The basket assembly of the refrigerator may: a basket configured to accommodate food; a first base provided to be slidable in the front direction of the first door by passing through the opening of the first door, the basket being placed on an upper surface of the first base; a second base provided to be slidable in the rear direction of the first door, the first base being slidably coupled to an upper surface of the second base; and a third base of which a front end is fixed to a rear surface of the first door.

The second base may be slidably coupled to an upper surface of the third base.

Advantageous Effects

According to the refrigerator having the door basket according to the embodiment of the present invention, it is characterized that the basket can be bidirectionally drawn out toward the front surface and the rear surface of the door. Therefore, a user can open an external door and then can accommodate or take out food in/from the basket at a front of an internal door, and also can open the internal door and then can accommodate or take out food in/from the basket at a rear of the internal door.

DESCRIPTION OF DRAWINGS

FIG. 1 is a perspective view of a refrigerator according to one embodiment of the present invention.

FIG. 2 is a front perspective view of a door assembly illustrating an opened state of a first door.

FIG. 3 is an exploded perspective view of a basket assembly according to one embodiment of the present invention, when seen from a front side.

FIG. 4 is an exploded perspective view of the basket assembly, when seen from a rear side.

FIG. 5 is a longitudinal cross-sectional view taken along V-V of FIG. 2.

FIG. 6 is a perspective view of the door assembly illustrating a state in which a basket is drawn out forward.

FIG. 7 is a longitudinal cross-sectional view taken along VII-VII of FIG. 6.

FIG. 8 is a front perspective view of the door assembly illustrated a state in which the basket is drawn out backward.

FIG. 9 is a rear perspective view of the door assembly illustrated the state in which the basket is drawn out backward.

FIG. 10 is a longitudinal cross-sectional view taken along X-X of FIG. 9.

MODE FOR INVENTION

Hereinafter, exemplary embodiments of the present invention will be described in detail with reference to the accompanying drawings.

FIG. 1 is a perspective view of a refrigerator according to one embodiment of the present invention.

Referring to FIG. 1, the refrigerator 1 according to one embodiment of the present invention may include a cabinet 10 having a refrigerator compartment 10*a* and a freezer compartment 10*b* formed therein, and a door assembly 20 which is coupled to a front surface of the cabinet 10 and selectively opens and closes the refrigerator compartment 10*a* and the freezer compartment 10*b*.

The refrigerator compartment 10*a* and the freezer compartment 10*b* may be vertically or horizontally arranged. In the embodiment, a bottom freezer type refrigerator in which the refrigerator compartment 10*a* is located at an upper side and the freezer compartment 10*b* is located at a lower side is described as an example.

The door assembly 20 may include a refrigerator door 21 which opens and closes the refrigerator compartment 10*a*, and a freezer door 22 which opens and closes the freezer compartment 10*b*.

Also, the refrigerator door 21 may include a first door 211 which is rotatably coupled to the front surface of the cabinet 10, and a second door 212 which is rotatably coupled to a front surface of the first door 211. The first door 211 and the second door 212 may be connected to the cabinet 10 and the second door 211, respectively, by a hinge assembly 23. The first door 211 and the second door 212 may be defined as a rear door and a front door, or an internal door and an external door, respectively.

Like the refrigerator door 21, the freezer door 22 may be rotatably coupled to the front surface of the cabinet 10. Alternatively, the freezer door 22 may be formed in a drawer type, and may be provided at the freezer compartment 10*b* to be able to be drawn out.

FIG. 2 is a front perspective view of the door assembly illustrating an opened state of the first door.

Referring to FIG. 2, the refrigerator door 21 according to the embodiment of the present invention may include the first door 211 and the second door 212, as described above. The first door 211 may open and close the refrigerator compartment 10*a*, and an accommodation module 40 may be installed at a rear surface thereof.

A separate accommodation space 213 which is separated from the refrigerator compartment 10*a* may be formed at an inside of the accommodation module 40. The accommodation space 213 may be defined at an inside of a case 41 which protrudes from a rear surface of the first door 211. One or a plurality of baskets 42 in which a drink container or food is accommodated may be installed at the inside of the accommodation module 40.

Also, an opening 212*a* which is in communication with the accommodation space 213 is formed in the first door 211. The opening 212*a* is selectively opened and closed by the second door 212. A horizontal width and a vertical width of the opening 212*a* may be formed corresponding to a horizontal width and a vertical width of a front surface of the case 41.

The hinge assembly 23 includes a first hinge 231 which connects an upper surface of the first door 211 with an upper surface of the cabinet 10, and a second hinge 232 which connects an upper surface of the second door 212 with the upper surface of the first door 211.

Also, a drawing out hole 41*a* may be formed at a rear surface of the case 41, specifically, a lower side of the rear surface of the case 41 so that at least one of the baskets 42 is drawn out toward a rear of the first door 211. By such a structure, at least one of the baskets 42 may be drawn out forward through the opening 212*a*, while the second door 212 is opened, and may also be drawn out toward the rear of the first door 211 through the drawing out hole 41*a*, while the first door 211 is opened.

An edge of the rear surface of the first door 211 is in close contact with the front surface of the cabinet 10, and an edge of a rear surface of the second door 212 is in close contact with the front surface of the first door 211. The first door 211 and the second door 212 are rotated in the same direction, and thus open and close the refrigerator compartment 10*a* and the accommodation space 213, respectively.

For example, when the second door 212 is opened in a state in which the first door 211 is closed, access to the accommodation space 213 through the opening 212*a* is allowed. That is, while only the second door 212 is opened, the food accommodated in the accommodation space 213 may be taken out, or the food may be accommodated in the accommodation space 213.

Although not shown in the drawings, a first sealer may be installed at a periphery of the rear surface of the first door 211. Also, when the first door 211 is closed, the first sealer is in close contact with the front surface of the cabinet 10, and thus cool air is prevented from leaking. The first sealer is formed of a material which may be elastically deformed, and thus may be formed to be compressible.

A second sealer 72 which is in contact with a periphery of the front surface of the first door 211 may be provided at a periphery of the rear surface of the second door 212. The second sealer 72 may be formed of the same material as that of the first sealer, such as rubber and silicon, which may be elastically deformed, and thus may be formed to be compressible. Therefore, while the second door 212 is closed, the second sealer 72 is in close contact with the front surface of the first door 211, and the cool air is prevented from leaking.

A locking unit 65 may be provided between the second door 212 and the first door 211 to maintain a closed state between the second door 212 and the first door 211, i.e., a close contact state therebetween. The locking unit 65 may include a latch hook 66 which protrudes from the rear surface of the second door 212, and a latch holder 67 which is installed at the front surface of the first door to catch the latch hook 66. Alternatively, the latch hook 66 may be formed at the first door, and the latch holder 67 may be installed at the second door 212.

FIG. 3 is an exploded perspective view of a basket assembly according to one embodiment of the present invention, when seen from a front side, and FIG. 4 is an exploded perspective view of the basket assembly, when seen from a rear side.

Referring to FIGS. 3 and 4, the basket assembly according to the embodiment of the present invention may include the basket 42, a base assembly 100 which supports the basket 42, and a rail assembly which connects the base assembly 100 with the basket 42 and guides forward and backward drawing out of the basket 42.

The base assembly 100 is installed at a bottom of the basket 42 to support the basket 42 when the basket 42 is drawn out toward the front and rear of the first door 211.

The base assembly 100 may include a first base 110 on which the basket 42 is put, a second base 120 which is coupled to a lower portion of the first base 110, and a third base 130 which is coupled to a lower portion of the second base 120. The third base 130 is fixed to the rear surface of the first door 211, and, while the basket 42 is accommodated in the case 41, front surfaces of the first base 110 and the second base 120 may be designed to be on the same plane as the front surface of the first door 211, as illustrated in the drawings. A front surface of the basket 42 may also be designed to be on the same plane as the front surface of the first door 211. However, the present invention is not always limited thereto. It is sufficient that the front surfaces of the basket 42 and the first and second bases 110 and 120 are on the same plane as the front surface of the first door 211, or are located slightly to the rear of the front surface of the first door 211, and thus the second door 212 is completely in close contact with the front surface of the first door 211.

The basket 42 is provided to be separable from the first base 110. For example, one or a plurality of protrusions and grooves corresponding to the protrusions may be formed at a lower surface of the basket 42 and an upper surface of the first base 110, respectively. Therefore, when the basket 42 is put on the first base 110, the basket 42 is not separated from the first base 110 due to inertia, when the first base 110 is horizontally moved. In addition, when the basket 42 is lifted up, the basket 42 may be easily separated from the first base 110.

Specifically, the first base 110 is provided to be slidable on the second base 120 toward the front and rear of the first door 211. Also, the second base 120 is also provided to be slidable on the third base 130 toward the front and rear of the first door 211.

To enable the first base 110 to be slidable on the second base 120, a first rail assembly is provided at a lower surface of the first base 110 and an upper surface of the second base 120. The first rail assembly may include a first rail part 112 which is installed at any one side of the lower surface of the first base 110 and the upper surface of the second base 120, and a first rail guide 122 which is installed at the other one side.

Further, a second rail assembly may be provided at a lower surface of the second base 120 and an upper surface of the third base 130, and thus the second base 120 may be slidable forward and backward on the third base 130. Like the first rail assembly, the second rail assembly may include a second rail part 124 and a second rail guide 132. Specifically, the second rail part 124 may be installed at any one side of the lower surface of the second base 120 and the upper surface of the third base 130, and the second rail guide 132 may be installed at the other one side.

Meanwhile, the basket assembly may further include a rear cover 140 which supports a rear surface of the basket 42, and the drawing out hole 41*a* is selectively opened and closed by the rear cover 140. The rear cover 140 may be integrally coupled with the second base 120. Therefore, when the second base 120 is moved backward, the rear cover 140 may be also moved together to open the drawing out hole 41*a*.

FIG. 5 is a longitudinal cross-sectional view taken along V-V of FIG. 2.

Referring to FIG. 5, when the second door 212 is opened, access to the basket 42 installed at the accommodation module 40 through the opening 212*a* is allowed.

Specifically, the plurality of baskets 42 may be vertically arranged at regular intervals in the accommodation module 40. However, in two baskets which are vertically adjacent to each other, a space between a lower surface of an upper basket and an upper surface of a lower basket may be designed to be very narrow, as illustrated in the drawing. In this case, to take out the food accommodated in the lower basket 42, the lower basket 42 should be drawn out forward so that an opened upper surface of the lower basket 42 is exposed to an outside.

Also, while the lower basket 42 is not moved, the drawing out hole 41*a* is maintained in a closed state by the rear cover 140. A rear surface of the accommodation module 40 is on the same plane as an outer surface of the rear cover 140.

FIG. 6 is a perspective view of the door assembly illustrating a state in which the basket is drawn out forward, and FIG. 7 is a longitudinal cross-sectional view taken along VII-VII of FIG. 6.

Referring to FIGS. 6 and 7, when a user opens the second door 212 and then pulls the basket 42 forward, the basket 42 is drawn out forward through the opening 212*a*. The opened upper surface of the basket 42 is exposed to the outside, and thus the user may check the accommodation space 213 of the basket 42. And the user may accommodate the food in the accommodation space 213 or may take out the food accommodated in the accommodation space 213.

Specifically, when the basket 42 is drawn out forward, the first base 110 is fixed to the lower surface of the basket 42 and thus integrally moved with the basket 42. The first base 110 is slide forward along the upper surface of the second base 120 by an operation of the first rail assembly.

Here, to prevent the basket 42 from being excessively drawn out forward, being separated and falling down, a stopper structure which restricts a drawing out distance of the basket 42 may be installed.

For example, a stopping protrusion may protrude at a rear end of a side surface of the first base 110, and a protruding portion which interferes with the stopping protrusion or a stopping groove in which the stopping protrusion is caught may be formed at a side surface of the opening 212*a*. Then, the basket 42 is drawn out forward until the stopping protrusion is caught by the protruding portion or the stopping groove, and thus the drawing out distance of the basket 42 may be restricted. Alternatively, the stopping groove may extend to a predetermined length at both side surfaces or one side surface of the first base 110, and the stopping protrusion may protrude at both side surfaces or one surface of the opening 212*a* to be inserted into the stopping groove. Then, since the first base 110 is drawn out only when the stopping protrusion is caught by a rear end of the stopping groove, the drawing out distance of the basket 42 may be restricted.

Alternatively, the stopper structure may be provided at the first rail assembly itself. For example, the stopping protrusion and the stopping groove which perform the stopping function may be provided at the first rail part 112 and the first rail guide 122, respectively, and a drawing out limit of the first rail part 112 may be established. The stopping protrusion may protrude at both the first rail part 112 and the first rail guide 122, and a front surface of the stopping protrusion of the first rail part 112 may be caught by a rear surface of the stopping protrusion of the first rail guide 122, and thus a drawing out distance of the first base 110 may be restricted.

As another alternative, the stopping protrusion may be provided at one of the lower surface of the first base 110 and the upper surface of the second base 120, and the stopping groove which accommodates the stopping protrusion and restricts the movement of the stopping protrusion may be formed at the other one.

As a part for restricting the drawing out distance of the basket 42, various types of stopper structures other than the above-described stopping protrusion may be proposed.

FIG. 8 is a front perspective view of the door assembly illustrated a state in which the basket is drawn out backward, FIG. 9 is a rear perspective view of the door assembly illustrated the state in which the basket is drawn out backward, and FIG. 10 is a longitudinal cross-sectional view taken along X-X of FIG. 9.

Referring to FIGS. 8 to 10, while the first door 211 is opened, the user may take out the food or the like accommodated in the accommodation module 40 from the rear of the first door 211.

Specifically, when the first door 211 is rotated and separated from the front surface of the cabinet 10, the accommodation module 40 is separated from the refrigerator compartment 10*a*, and exposed to the outside. That is, the rear cover 140 which is disposed at a lower side of the accommodation module 40 is exposed to the outside, and is in a state which is operable by the user.

In this state, when the user grips a handle 141 formed at the rear cover 140 and pulls the handle 141 toward the rear of the first door 211, the second base 120 which is integrally coupled with the rear cover 140 is slid on the upper surface of the third base 130.

Specifically, the second base 120 is gently moved backward along the upper surface of the third base 130 by an operation of the second rail assembly. Here, the first base 110 is in a coupled state with the second base 120, and thus, when the second base 120 is moved backward, the first base 110 and the basket 42 situated on the upper surface of the second base 120 are also moved backward.

Also, the rear cover 140 is horizontally moved from a rear surface of the accommodation module 40, and the opened upper surface of the basket 42 is exposed to the outside. In this state, the user may take out the food accommodated in the basket 42, or may accommodate the food in the basket 42.

Meanwhile, a stopper structure for establishing a backward drawing out distance of the basket 42 may be provided. The stopper structure may be formed to be the same as the stopper structure for establishing the drawing out limit of the first base 110, and thus may be provided at the second rail assembly in the stopping protrusion and stopping groove type or the stopping protrusion and protruding portion type. Alternatively, as described above, the stopping protrusion and the stopping groove may be formed at the lower surface of the second base 120 and the upper surface of the third base 130, respectively.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A refrigerator, comprising:

a cabinet configured to form a storage space;

a first door coupled to a front surface of the cabinet to selectively open and close the storage space, and having an opening formed therein;

a second door coupled to a front surface of the first door and configured to selectively open and close the opening of the first door;

a first hinge configured to rotatably couple the first door to the cabinet;

a second hinge configured to rotatably couple the second door to the first door; and a basket assembly slidably coupled to the first door in a front-to-rear direction of the first door, wherein the basket assembly comprises:

a basket configured to accommodate food;

a first base provided to be slidable in the front direction of the first door by passing through the opening of the first door, the basket being placed on an upper surface of the first base;

a second base provided to be slidable in the rear direction of the first door, the first base being slidably coupled to an upper surface of the second base; and a third base of which a front end is fixed to a rear surface of the first door, wherein the second base is slidably coupled to an upper surface of the third base.

2. The refrigerator of claim 1, further comprising a case provided at the rear surface of the first door and configured to form an accommodation space in which the basket is accommodated, wherein the case has a drawing out hole which enables the basket to be drawn out of the accommodation space and to be drawn out toward the rear of the first door.

3. The refrigerator of claim 2, further comprising a rear cover coupled to an end of the second base and configured to selectively open and close the drawing out hole, wherein, while the basket is accommodated in the accommodation space, an outer surface of the rear cover is on the same plane as a rear surface of the case.

4. The refrigerator of claim 2, further comprising a first rail assembly configured to connect a lower surface of the first base with an upper surface of the second base, wherein, due to the first rail assembly, a front surface of the first base is able to pass through the opening and to be slid forward from a front surface of the first door by a predetermined distance.

5. The refrigerator of claim 4, wherein the first rail assembly comprises a first rail part installed at one of the lower surface of the first base and the upper surface of the second base, and a first rail guide installed at the other one of the lower surface of the first base and the upper surface of the second base.

6. The refrigerator of claim 5, further comprising a stopper member configured to establish a forward drawing out limit of the first base.

7. The refrigerator of claim 6, wherein the stopper member comprises a stopping protrusion configured to protrude from an edge of at least one side surface of the opening toward a center of the opening, and a stopping groove configured to extend from an edge of at least one side surface of the first base by a predetermined length in a forward and backward direction and to accommodate the stopping protrusion.

8. The refrigerator of claim 6, wherein the stopper member comprises a stopping protrusion configured to protrude from one of the lower surface of the first base and the upper surface of the second base, and a stopping groove configured to extend from the other one of the lower surface of the first base and the upper surface of the second base by a predetermined length in a forward and backward direction and to accommodate the stopping protrusion.

9. The refrigerator of claim 6, wherein the stopper member comprises a stopping protrusion configured to protrude from each of the first rail part and the first rail guide and to interfere with each other.

10. The refrigerator of claim 6, wherein the stopper member comprises a stopping protrusion configured to protrude from one of the first rail part and the first rail guide, and a stopping groove configured to extend from the other one of the first rail part and the first rail guide by a predetermined length and to accommodate the stopping protrusion.

11. The refrigerator of claim 4, further comprising a second rail assembly configured to connect a lower surface of the second base with an upper surface of the third base, wherein, due to the second rail assembly, a rear end of the second base is able to be drawn out of the accommodation space and to be slid backward from a rear surface of the case by a predetermined distance.

12. The refrigerator of claim 11, wherein the second rail assembly comprises a second rail part installed at one of the lower surface of the second base and the upper surface of the third base, and a second rail guide installed at the other one of the lower surface of the second base and the upper surface of the third base.

13. The refrigerator of claim 12, further comprising a stopper member configured to establish a backward drawing out limit of the second base.

14. The refrigerator of claim 13, wherein the stopper member comprises a stopping protrusion configured to protrude from one of the lower surface of the second base and the upper surface of the third base, and a stopping groove configured to extend from the other one of the lower surface of the second base and the upper surface of the third base by a predetermined length in a forward and backward direction and to accommodate the stopping protrusion.

15. The refrigerator of claim 13, wherein the stopper member comprises a stopping protrusion configured to protrude from each of the second rail part and the second rail guide and to interfere with each other.

16. The refrigerator of claim 13, wherein the stopper member comprises a stopping protrusion configured to protrude from one of the second rail part and the second rail guide, and a stopping groove configured to extend from the other one of the second rail part and the second rail guide by a predetermined length and to accommodate the stopping protrusion.

* * * * *